US006924780B1

(12) United States Patent
Horst et al.

(10) Patent No.: US 6,924,780 B1
(45) Date of Patent: Aug. 2, 2005

(54) SPATIAL DISPLAY OF DISK DRIVE ACTIVITY DATA

(75) Inventors: Robert W. Horst, Saratoga, CA (US); Bryan T. Silbermann, Saratoga, CA (US)

(73) Assignee: 3ware, Inc., Sunnyvale, CA (US)

( * ) Notice: Subject to any disclaimer, the term of this patent is extended or adjusted under 35 U.S.C. 154(b) by 724 days.

(21) Appl. No.: 09/634,744

(22) Filed: Aug. 9, 2000

(51) Int. Cl.[7] ..... G09G 3/32

(52) U.S. Cl. ..... 345/82; 345/83; 345/55; 345/76; 711/112; 711/113; 711/4

(58) Field of Search ..... 345/82, 83, 55, 345/76; 711/4, 112–113, 202; 360/901, 994

(56) References Cited

U.S. PATENT DOCUMENTS 5,214,762 A 5/1993 Bush et al.
5,305,013 A * 4/1994 Daniels ..... 345/82
5,390,327 A 2/1995 Lubbers et al.
5,581,690 A 12/1996 Ellis et al.
5,596,708 A 1/1997 Weber
5,737,744 A 4/1998 Callison et al.
5,761,527 A 6/1998 Clohset et al.
5,774,643 A * 6/1998 Lubbers et al. ..... 714/20
5,790,374 A 8/1998 Wong
5,881,250 A 3/1999 Young
5,889,930 A 3/1999 Fukudome
5,952,985 A * 9/1999 McKinney et al. ..... 345/42
6,191,758 B1 * 2/2001 Lee ..... 345/2.2
6,425,053 B1 7/2002 Considine et al.
6,532,505 B1 * 3/2003 Stracovsky et al. ..... 710/63

* cited by examiner

*Primary Examiner*—Vijay Shankar
*Assistant Examiner*—Leonid Shapiro
(74) *Attorney, Agent, or Firm*—Knobbe, Martens, Olson & Bear LLP

(57) ABSTRACT

Real time disk activity data for a disk drive is displayed on a multi-element display in which each display element corresponds to a respective address range or "activity bin" of the disk drive. When an access to the disk drive occurs, the display element associated with the corresponding address is illuminated, with the color of the illuminated element preferably indicating the type of the access (e.g., read versus write). The display thus spatially indicates the type of disk activity occurring. For example, a user can readily determine that a disk drive is being accessed sequentially by identifying that the display elements are being illuminated in sequence over time. In addition, the user can, in many cases, evaluate the operation of an array of disk drives by viewing and comparing the illumination patterns of the associated multi-element displays. For example, a user can easily confirm that one drive in mirroring another drive by verifying that their illumination patterns are synchronized. In a preferred embodiment, each multi-element display is an 8×8 matrix of multi-color display elements, and is viewable from outside of the computer cabinet in which the drive is housed. The display method may also be embodied within a graphical user interface of a system administration software tool.

50 Claims, 17 Drawing Sheets

402 404

| Index | LED sequence | Pulsed | Color | Usage |
|---|---|---|---|---|
| 0 | OOOOOOOO OOOOOOOO | N | Off | Default |
| 1 | OOOOOOOO GGGGGGGG | Y | Green pulse | Disk read to this bin |
| 2 | RRROOOOO GGGGGGOO | Y | Yellow pulse | Disk write to this bin |
| 3 | OOOOOOOO GOOOOOOO | N | Light green | Disk spinning |
| 4 | RROOOOOO GOOOOOOO | N | Light orange | Disk spinning up/down |
| 5 | RRRRRRRR GGGOOOOO | N | Reddish orange | Big X of drive to replace |
| 6 | RROOOOOO GGGGGGGG | N | Yellow green | "S" for spare drive |
| 7 | OOOOOOOO GGGGGGGG | N | Green | Status message |
| 8 | RRRRRRRR GGGGOOOO | N | Orange | Error message |
| 9 | | | | future use |
| 10 | | | | future use |
| 11 | | | | future use |
| 12 | | | | future use |
| 13 | | | | future use |
| 14 | | | | future use |
| 15 | | | | future use |

FIG. 4

```
1   //Bin Calculation Pseudocode - Bit Masking Version
2
3   (4 byte, 32 bit binary) requested_lba = LBA of requested disk operation
4
5   (4 byte binary) last_lba = LBA of last valid logical block on disk drive
6
7   (int) zeros = number of zeros to the left of the first "1" bit in the last_lba
8
9   (binary) bin = (requested_lba <<zeros) >> (32-6)
10  //shift the last_lba to the left to get rid of zeros
11  //then shift to the right by 32 bits - 6 to get
12  //highest 6 bits of requested_lba
13  //which is the number of the bin in binary
```

FIG. 6B

```
1   //Bin Calculation Pseudocode - Division Version
2
3   (4 byte, 32 bit binary) requested_lba = LBA of requested disk operation
4
5   (4 byte binary) last_lba = LBA of last valid logical block on disk drive
6
7   (int) lbas = last_lba + 1 = number of valid LBA's for disk drive
8
9   (int) lbas_per_bin = lbas/64
10  //divide the number of lbas by the number of bins (64)
11
12  (int) bin = requested_lba/lbas_per_bin
13  //the bin is the requested LBA divided by the number of LBAs per bin
```

FIG. 7B

```
Table initialization Pseudocode

(4 byte binary) last_lba = LBA of last valid logical block on disk drive

(int) zeros = number of zeros to the left of the first 1 bit in the last_lba

(4 byte binary) last_table_entry = (last_lba << zeros) >> 22
//shift the last_lba to the left to get rid of zeros
//then shift to the right 22 bits (4 bytes - 10 bits) to get
//10 most significant bits

(int array) Table
//array of 1024 table entries addressable by 10 bits
//each table entry stores a bin number

(int) table_entries = last_table_entry + 1
//this is the number of table entries that are actually used

(real) entries_per_bin = table_entries/bins
//number of table entries per bin

for table_address = 0 to 1023
(int) Table(table_address) = (real) table_address/(real) entries_per_bin
//table entry is the table address divided by number of entries per bin
//rounded down to nearest whole number
```

FIG. 9B

```
Table initialization Pseudocode

(4 byte binary) last_lba = LBA of last valid logical block on disk drive

(int) zeros = number of zeros to the left of the first 1 bit in the last_lba

(4 byte binary) last_table_entry = (last_lba << zeros) >> 22
//shift the last_lba to the left to get rid of zeros
//then shift to the right 22 bits (4 bytes - 10 bits) to get
//10 most significant bits

(int) table_entries = last_table_entry + 1
//this is the number of table entries that are actually used

(int array) Table
//array of 1024 table entries addressable by 10 bits
//each table entry stores a bin number

(int) bin = 0

for table_address = 0 to 1023
{
        if table_address < (bin + 1) * (table_entries)/64
                Table (table_address) = bin
else
        bin = bin + 1
}
```

FIG. 9C

```
Bin Lookup Pseudocode

(4 byte, 32 bit binary) requested_lba = LBA of requested disk operation

(4 byte binary) last_lba = LBA of last valid logical block on disk drive

(int) zeros = number of zeros to the left of the first "1" bit in the last_lba

table_address = (requested_lba << zeros) >> 22
//similar to table creation

bin = Table (table_address)
```

FIG. 10B

SPATIAL DISPLAY OF DISK DRIVE ACTIVITY DATA

BACKGROUND OF THE INVENTION

1. Field of the Invention

This invention relates generally to hard disk drive and disk array technology and, more particularly, the invention relates to the use of a multi-element display to display disk drive activity data.

2. Description of the Related Art

Disk arrays provide vast amounts of storage as well as flexibility in speed and reliability. These arrays are often configured to operate as RAID arrays, otherwise knows as Redundant Arrays of Inexpensive Disks, to provide added speed and reliability. Disk arrays can also be configured as JBODs (Just a Bunch of Disks) in which several disks are used to provide large storage capacities. As system administrators take on the responsibility of managing increasing numbers of disk arrays, it becomes increasingly difficult to quickly verify the proper operation of all of the disks or disk arrays for which they are responsible.

Various types of monitoring mechanisms exist for assisting system administrators in monitoring disk drive and disk array activity. For example, disk drives typically include indicator LEDs (light-emitting diodes) that light up during disk activity. In addition, various types of storage maintenance tools exist that allow system administrators to remotely monitor disk arrays and other storage resources over a computer network. Although these mechanisms are helpful, they do not provide an efficient and intuitive display method for indicating the types of disk activity data commonly needed by system administrators, programmers, and other users.

SUMMARY OF THE INVENTION

The present invention provides a highly intuitive display method for indicating disk drive activity data, including the location (address range) of each access to the disk drive. The invention is particularly helpful to the management of disk arrays, but may also be used to monitor independent disk drives.

In accordance with the invention, the real time disk activity data for a disk drive is displayed on a multi-element display in which each display element corresponds to a respective address range or "activity bin" of the disk drive. When an access to the disk drive occurs, the display element associated with the corresponding address is illuminated, with the color of the element preferably indicating the type of the access (e.g., read versus write). The display thus spatially indicates the type of disk activity occurring. For example, a user can readily determine that a disk drive is being accessed sequentially by identifying that the display elements are being illuminated in sequence over time. In addition, the user can, in many cases, evaluate the operation of an array of disk drives by viewing and comparing the illumination patterns of the associated multi-element displays. For example, a user can confirm that one drive in mirroring another drive by verifying that their illumination patterns are synchronized.

In one embodiment, the multi-element display is an N×N (e.g., 8×8) matrix of multi-color display elements. The display is preferably positioned adjacent the disk drive and is visible from the exterior of the cabinet or box in which the disk drive is housed. Where the cabinet houses an array of disk drives, one such N×N display is provided for each disk drive, and these displays are mounted in alignment with one another to facilitate comparisons of disk activity. In operation, a control circuit which preferably resides external to the disk drive(s) uses a lookup table or other mapping scheme to map selected bits of the disk access addresses (preferably logical block addresses) to corresponding activity bin and display elements. The identification of the activity bin and the type of the operation are used to update a pixel map of the disk drive's display. A display microcontroller illuminates the display elements of the display based upon the colors indicated in the pixel map. In a preferred disk array embodiment, the task of mapping disk addresses to activity bins for the entire disk array is performed by a first processor, and the task of illuminating the displays for all disk drives is performed by a second processor.

A number of variations to the display method are possible. For example, the illumination patterns could be "inverted" such that each display element is temporarily turned off when an access occurs to the corresponding address range. In addition, rather than illuminating the display elements one-at-a-time, all display elements falling below that of the current access location could be illuminated.

The display methods of the invention may also be embodied within a graphical user interface of a computer program used to monitor storage resources over a computer network. In such embodiments, each display element may be in the form of a group of pixels on a display screen. The user interface may allow the user to select the specific drives and/or disk arrays to be monitored on the display screen, and may allow the user to drag-and-drop a multi-element display to a new screen location to facilitate side-by-side comparisons of disk drives.

Another variation is to include the control circuitry and/or firmware for driving the multi-element displays within the disk drives themselves. In such embodiments, each disk drive may include an extra port/connector for connecting the drive to a standard multi-element display. In addition, rather than using logical block addresses, the control circuitry could be configured to use physical disk addresses to select the display elements to illuminate.

BRIEF DESCRIPTION OF THE DRAWINGS

These and other features of the invention will now be described with reference to the drawings of a preferred embodiment, in which:

FIG. 4 illustrates the data of a color/brightness palette table in which possible sequences of illuminations of the red and green LEDs are preferably stored;

FIG. 6B illustrates example pseudocode through which the method of FIG. 6A may be implemented

FIG. 7B illustrates example pseudocode through which the method of FIG. 7A may be implemented;

FIGS. 9B and 9C illustrate two different example pseudocode implementations of the method illustrated in FIG. 9A;

FIG. 10B illustrates example pseudocode through which the method of FIG. 10A may be implemented.

DETAILED DESCRIPTION OF THE EMBODIMENTS

In the following description, reference is made to the accompanying drawings, which form a part hereof, and which show, by way of illustration, specific embodiments or processes in which the invention may be practiced. Where possible, the same reference numbers are used throughout the drawings to refer to the same or like components. In some instances, numerous specific details are set forth in order to provide a thorough understanding of the present invention. The present invention, however, may be practiced without the specific details or with certain alternative equivalent components and methods to those described herein. In other instances, well-known methods and components have not been described in detail so as not to unnecessarily obscure aspects of the present invention.

I. General Functionality and Associated Hardware

A. The Display Panel

Figure 1:
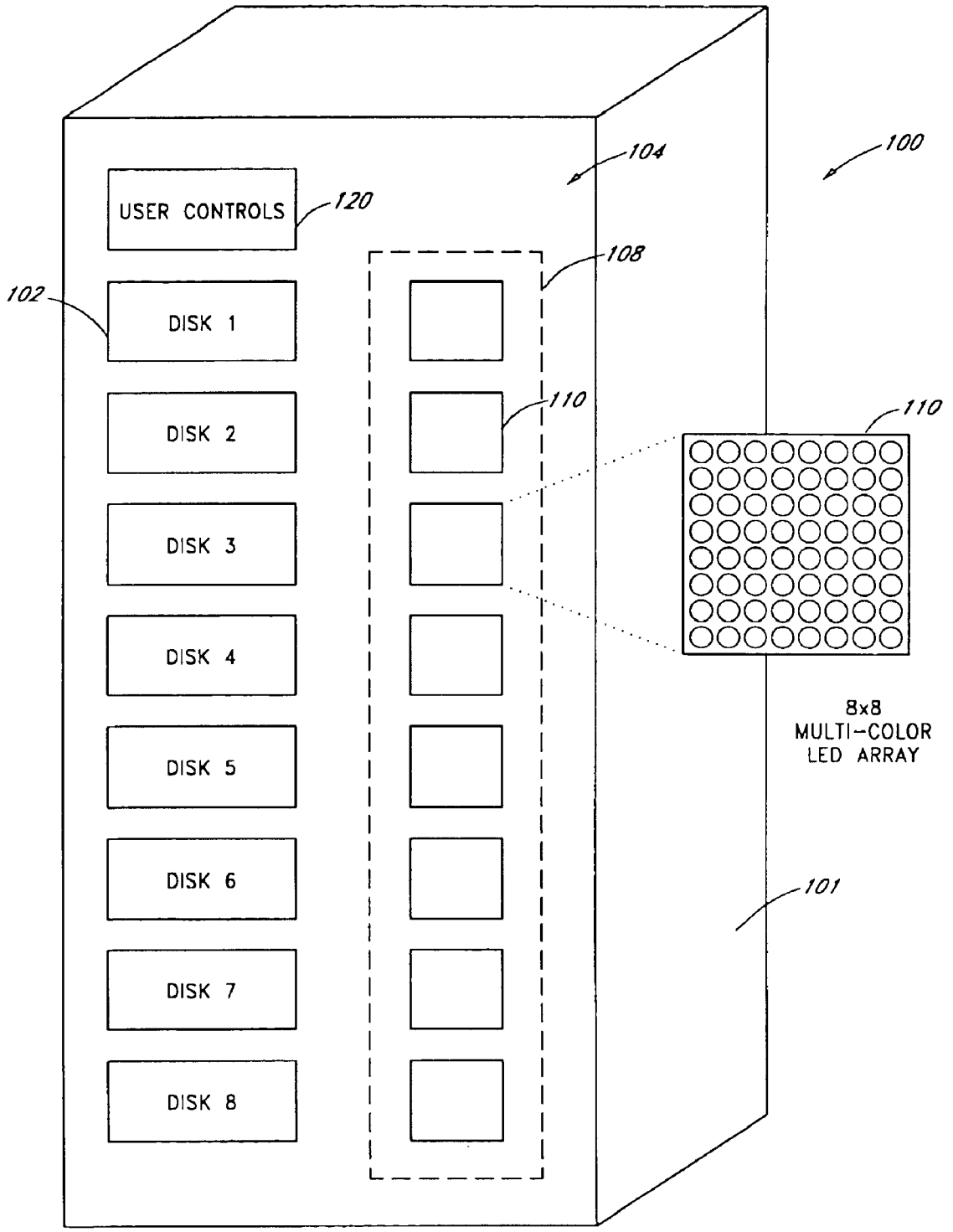
FIG. 1 illustrates a storage system including a disk drive array and a display panel for displaying the location of disk activity for the disk drives according to a preferred embodiment of the present invention.

FIG. 1 illustrates a storage system 100 including an array of disk drives 102 housed within a cabinet or enclosure 101. The storage system 100 may, for example, be configured as a network attached storage box to serve as a repository of data for one or more server computers. The storage system 100 may alternatively be configured as a server computer. The storage system 100 may alternatively be configured as a component of a computer such as a desktop workstation or a server.

The illustrated storage system 100 includes a disk array of 8 hot-swappable drives 102. As is conventional, the disk array may be configurable through hardware and/or software to operate in a particular mode, such as RAID 1, RAID 5, or JBOD. Although the invention will be described primarily in the context of a disk array system, the invention can also be used in conjunction with desktop computers and workstations having only a single disk drive.

As depicted in FIG. 1, the storage system 100 includes a display panel 108 for displaying the location of disk activity, status, and error information for each of the disk drives 102 according to a preferred embodiment of the present invention. The display panel includes a display 110 adjacent each disk drive 102 for displaying the activity of the corresponding drive 102. Each display 110 is preferably implemented as a two-dimensional LED array upon which the location of disk activity is spatially displayed using color to indicate the type (e.g. read or write) of the activity. The display panel 108 may be mounted on or through a front panel 104 of the storage system's cabinet 101, or may be visible through a transparent or translucent front panel 104. The display panel preferably also includes a set of user controls 120 through which a user can configure and control the operation of the storage system 100 and the display panel.

Figure 3A:
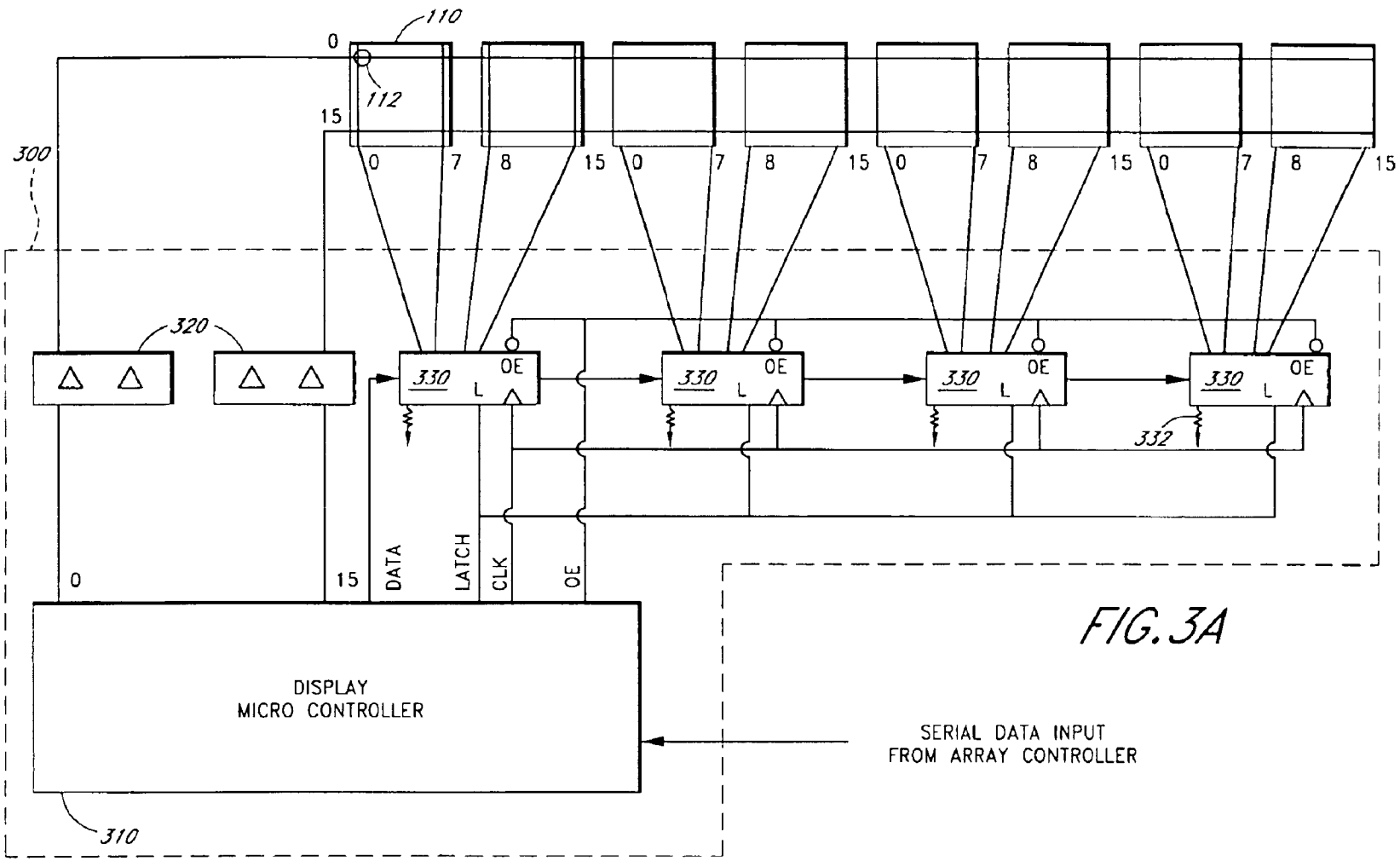
FIG. 3A illustrates a preferred embodiment of a display circuit that drives the LED arrays.

In a preferred embodiment, each LED array 110 is a MTAN6385-AHRG 8×8 Dot Matrix Display, available from Marktech Optoelectronics of Latham, N.Y. Each array 110 includes a total of 64 illuminatable display elements or dots 112, each of which can be illuminated by a red LED 382 (FIG. 3A) and a green LED 384 (FIG. 3A). Each display element can also be illuminated in various other colors in addition to red and green, such as yellow, that can be produced by cycling the illumination of the red and green LEDs for a display element. In the preferred embodiment, a green LED pulse indicates a disk read and a yellow pulse indicates a disk write.

Each display element 112 of an LED array 110 preferably corresponds to a range of addresses or locations on the corresponding disk drive. The display elements are preferably associated with the address ranges such that as the address ranges increase, the corresponding display elements go from left to right across rows and then from top to bottom from row to row down the LED array. The address ranges are preferably logical address ranges such as are specified by Logical Block Addresses (LBAs). Alternatively, the display elements may be associated with the physical locations on the disks themselves, such as are specified by Cylinder-Head-Sector addresses. In this case, display elements in the center of the LED array may be associated with lower cylinder numbers while the display elements toward the outside of the LED array may be associated with higher cylinder numbers.

The display panel 108 enables an operator or user to visually and intuitively evaluate the operation of the drives, and in many cases, determine whether the array is operating properly. For example, if two of the drives are operating in a mirrored mode, where one drive mirrors the operations of the other, the displays 110 of the two drives should illuminate identically (and substantially synchronously) as can easily be determined because all of the displays are mounted in alignment. By observing the activity on the displays, an operator can also distinguish, e.g., between random and sequential access to a disk drive. The location of activity on a drive may also allow an operator to determine whether a drive is nearly full. The activity on a display also serves as a strong cue to an operator not to remove a disk during activity. The ability to visually confirm the operation of a disk or an array of disks may also instill a sense of confidence in a system administrator that the system is functioning properly.

The 8×8 LED arrays 110 have enough display elements to display one or more characters. Accordingly, messages or error codes can be shown by displaying or flashing characters on or across the LED arrays (e.g. ERROR, DRIVE FAILURE). Anination techniques can also be used to display various other information. For example, an LED can be flashed around the perimeter of an LED array to indicate that a disk is spinning up or down. Additional visual cues may also indicate whether a drive is being used as a spare or an active drive.

In alternative embodiments, the display panel 108 may include fewer or more displays 110 based upon the number of disk drives in the system. For example, a computer having a single disk drive will typically include only a single display. The displays may be alternatively implemented with any applicable technology, such as liquid crystal displays or CRTs (Cathode Ray Tube monitors.

In one embodiment, the displays for all of the drives are additionally or alternatively displayed on a conventional CRT monitor, such as a monitor of a remote desktop computer of a system administrator. For example, a system administration tool may provide a graphical user interface through which the disk drive activity is depicted in real time using the same display methods as set forth herein, but with each display element being in the form of a group of pixels on the display screen. The disk activity data used to generate the real time displays may be broadcast on a network by the storage system 100 for this purpose. The user interface may allow the user to select the specific drives and/or disk arrays to monitor on the display screen, and/or may allow the user to drag-and-drop a multi-element display to a new screen location to facilitate comparisons of disk drive activity. For example, if the user wishes to compare the operation of disks 0 and 7 of a particular disk array, the user may be able to position the multi-element displays for these drives side-by-side on the display screen.

The configuration of the displays 110 may also be varied. For example, the display elements 112 may be configured along a line rather than in a matrix. In addition, the display elements may be configured in the shape of a disk to represent the topology of a hard disk platter.

In the preferred embodiment, the firmware that drives the display panel 108 may be configured in either of two orientation modes, allowing the display to be positioned in either a vertical or a horizontal fashion. The firmware may alternatively be configured to select between two modes based upon a state of a mercury switch that senses the orientation of the display. In the description of the preferred embodiment that follows, the display panel 108 is assumed to be oriented horizontally with the LEDs 112 of the LED arrays 110 arranged in 8 rows and 64 columns.

B. The Disk Array

Figure 2:
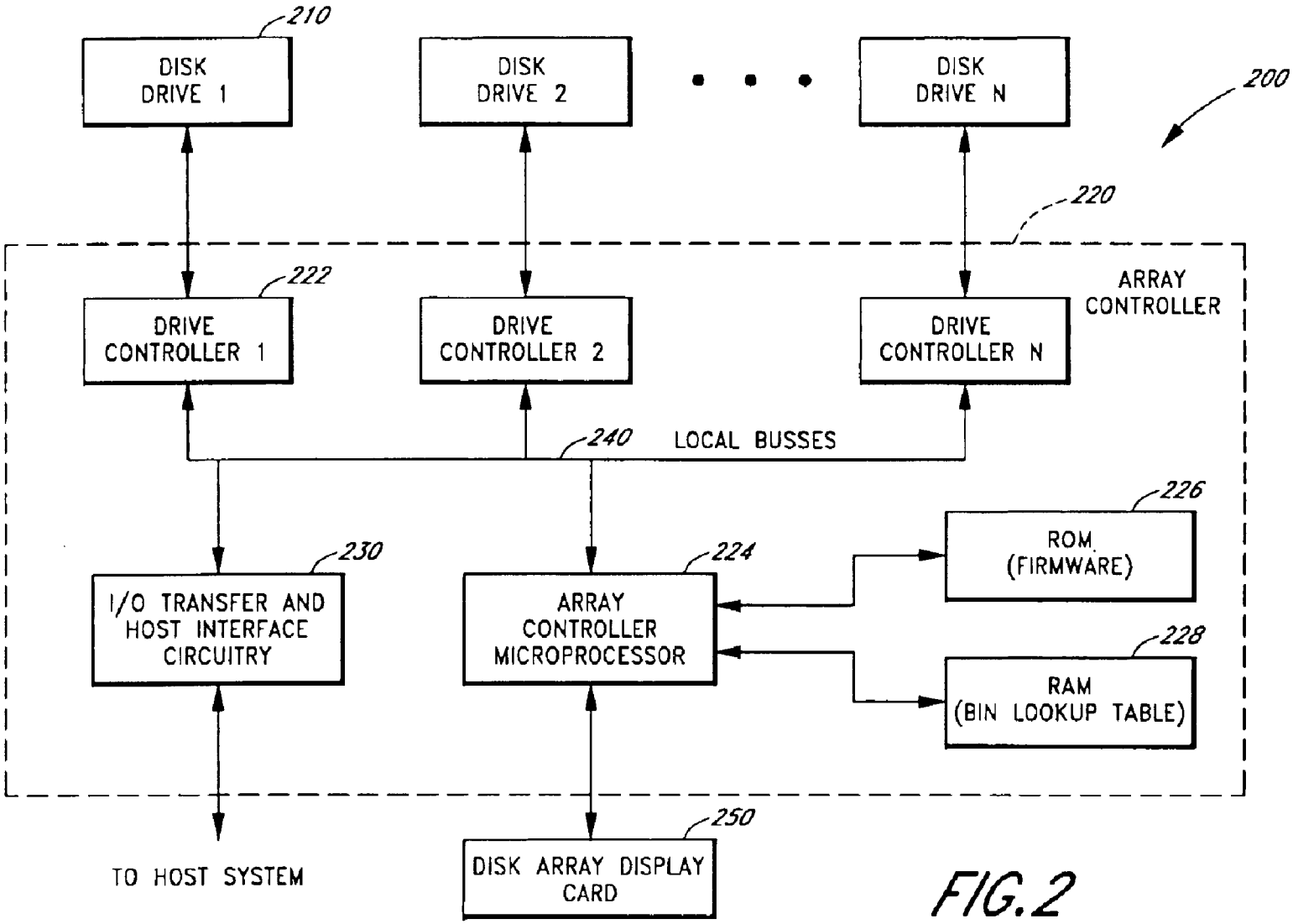
FIG. 2 is a general illustration of a disk array system configured in accordance with the present invention.

FIG. 2 is a general illustration of a disk array system 200 configured in accordance with the present invention. In general, practically any type of disk and/or disk array can be monitored according to the methods of the present invention. In the illustrated system, however, the disk array 200 is an array of ATA (Advanced Technology Attachment) disk drives. The disk array may alternatively be an array of SCSI (Small Computer System Interface) drives, and may include more or fewer drives. The array may be operated in a RAID configuration, in a JBOD configuration, or in another configuration.

The disk array 200 includes several disk drives 210 (numbered 1–N), which are controlled by an array controller 220. The array controller 220 preferably controls the configuration in which the disks operate (e.g. RAID), and connects the disk array to a host system, which may be a server computer or other computer system. The connection to the host system may be through a bus, such as a PCI (Peripheral Component Interconnect) bus. The connection to the host may alternatively be through a computer network and may include a network interface controller.

The array controller 220 preferably includes several. drive controllers 222 (numbered 1–N) that directly control the individual disk drives. In certain configurations, such as SCSI, one drive controller 222 may control several disk drives 210. The drive controllers 222 are in turn controlled by an array controller microcontroller or microprocessor 224. The microprocessor 224 identifies disk operations requested by the host system and implements the requests through the components of the array controller 220. The microprocessor 224 executes firmware code that is stored in a ROM (Read Only Memory) 226 to which the microprocessor has access. The firmware code preferably defines the particular functionality of the disk array 200 (such as RAID 4 or RAID 5).

The microprocessor 224 also has access to a RAM (Random Access Memory) 228 that it uses as a working memory. In the preferred embodiment, the microprocessor 224 stores an activity bin lookup table (discussed in Section H below) in the RAM memory 228. The activity bin lookup table is used to associate ranges of disk addresses with display elements 112 of the displays 110. The host system may communicate with the array controller 220 through I/O transfer and host interface circuitry 230 ("host interface"). The components of the array controller are internally connected through one or more local busses 240. The array controller may be constructed and may operate as generally described in WO 9926150A1, the disclosure of which is hereby incorporated by reference.

The array 200 also includes a disk array display card 250, which is preferably a PC board that forms part or all of the display panel 108. The disk array display card 250 preferably receives information from the microprocessor 224 through a serial connection implemented over a ribbon cable.

C. The Display Circuit

FIG. 3A illustrates a preferred embodiment of a display circuit 300 that drives the LED arrays 110. The display circuit 300 and the LED arrays 110 are preferably implemented on the disk array display card 250. The card 250 may be attached to a front panel 104 of the storage system 100 such that the displays 110 show through the panel. The displays 110 may alternatively be mounted behind the front panel and may be viewed through a transparent portion of the panel.

Figure 3B:
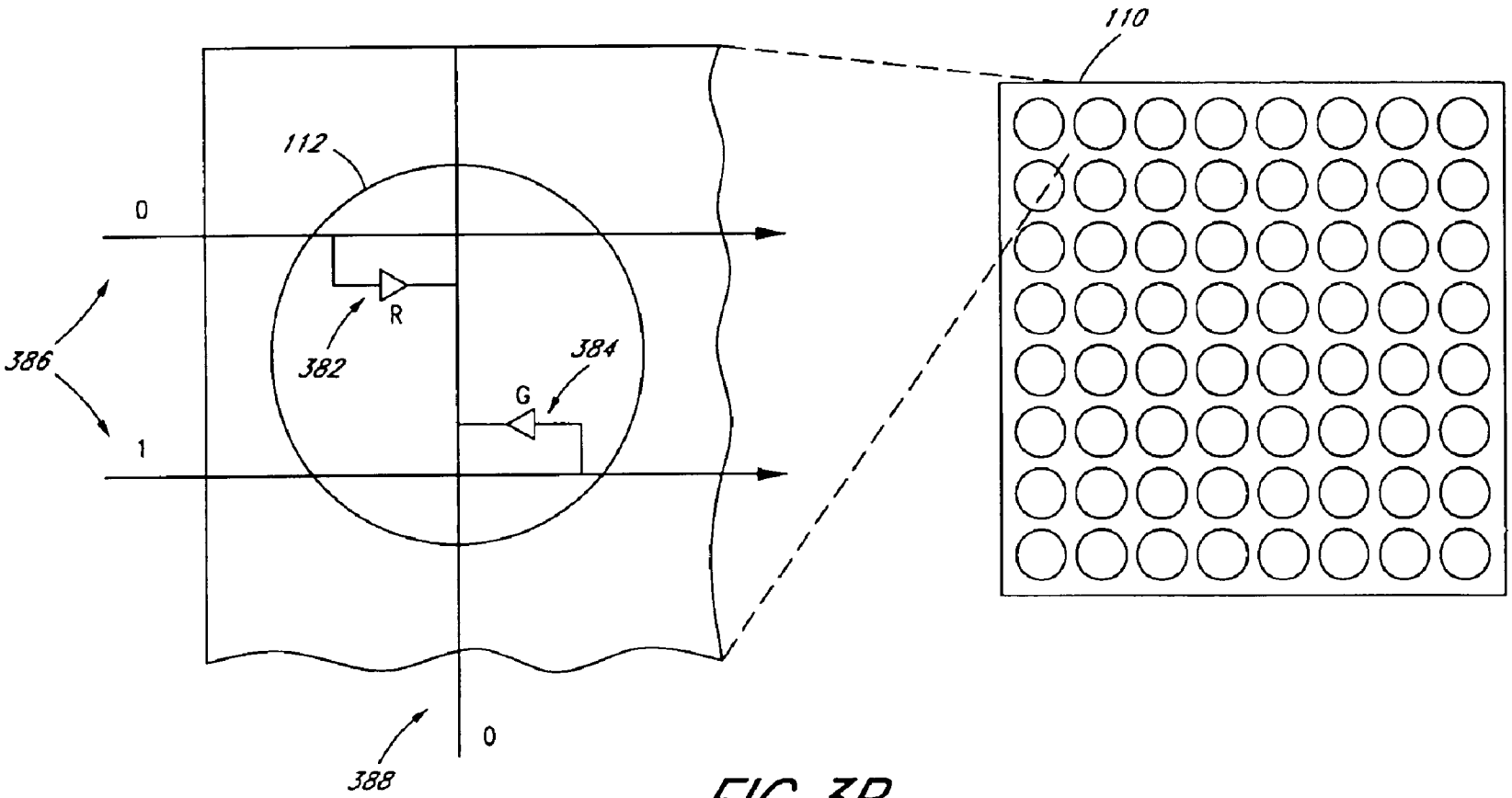
FIG. 3B illustrates a schematic of a display element in the upper left hand of one of the LED arrays in additional detail showing a red LED and a green LED.

FIG. 3B illustrates a schematic of the illuminatable display element (dot) 112 in the upper left hand of one of the LED arrays 110 in additional detail. Each display element 112 can be illuminated by a red LED 382 or a green LED 384. Additional or other color LEDs could alternatively be used depending upon the desired colors. The anodes of the two LEDs are connected to separate row lines 386. Since there are 8 display elements in each column, and each display element is illuminated by two diodes, there are 16 row lines total that drive the 16 diodes in each column. Each of the row lines extends across and connects to all of the diodes in each row across all of the displays 110. Across all 8 displays 110, there are 64 red diodes connected to the 0th row line and 64 green diodes connected to the 1st row line. These red and green diodes illuminate the first row of display elements 112 across all of the displays. The cathodes of all the LEDs in a single column of display elements are connected to a single column line 388. Accordingly, any single LED can be illuminated by driving a row line simultaneously with a column line. The row lines are preferably driven one after another in sequence and the corresponding column lines are driven at the appropriate times to allow different sets of LEDs to be illuminated in each row.

Referring again to FIG. 3A, the display circuit 300, includes an 8-microcontroller 310 (e.g. 89C51RC+IA), which has 32 kilobytes of flash memory and 512 bytes of RAM. The microcontroller 310 has 32 bits of general I/O. Sixteen of the I/O bits drive the row lines 386 through high-current high-side current drivers or transistors 320 (e.g. the TD6208N includes eight drivers on each chip).

The 64 column lines 388 of the 8 displays 110 are driven by four constant current 16-bit LED driver/shift register/ latches (shift registers) 330 (e.g. Toshiba 62706BF). The first shift register 330 is connected by a data line to another of the microcontroller's general I/O bits and the remaining shift registers 330 are linked serially with the first. The current provided by each of the shift registers is set by a resistor 332. The constant current drivers assure the same LED brightness despite possible variations in forward voltage drop across the diodes.

The microcontroller 310 drives the row lines 386 of the display one at a time through the I/O bits. For each row, the microcontroller drives the column lines 388 by shifting 64 bits of data into the shift registers, latching the data, and setting the output enable for the desired ON time. While the latched data is driven through column lines 388, the microcontroller shifts in the next 64 bits of data.

The displays 110 are preferably updated at a rate of at least 100 Hz to reduce flicker. Updating one of the 8 rows of display elements 112 every millisecond allows all of the rows to be updated in 8 milliseconds and provides better than a 120 Hz refresh rate. Each display element 112 can display several different colors and brightnesses by cycling the operation of the red 382 and green 384 diodes during the update of each row. The interval, for example I millisecond, allocated to each row of display elements 112 may be further subdivided into 16 subintervals, for example, of about 62 microseconds each. Eight of the subintervals can be used for driving the red LEDs 382 and 8 of the subintervals can be used for driving the green LEDs 384 in a row of display elements.

FIG. 4 illustrates the data of a colorlbrightness palette table 402 in which the sequences of illuminations of the red 382 and green 384 LEDs are stored in accordance with one embodiment. Each sequence identifies the subintervals during which either the red or green LEDs are illuminated. The table 402 is preferably stored in the microcontroller's RAM. The table 402 holds 16 entries of 2 bytes each for a total of 16 bits for each entry. The first eight bits specify the subintervals during which the red LED 382 is to be illuminated, while the second 8 bits specify the subintervals during which the green LED 384 is to be illuminated. Nine of the entries of the table 402 are shown filled with various possible sequences of illumination. The resulting color and intended use of each sequence is shown to the right of each entry.

In one embodiment, the microcontroller 310 maintains a complete pixel map of the display elements 112 is its memory. The map is 8 rows by 64 columns and holds 4 bits for each display element as an index into the color palette table 402. The 4 bits also index another corresponding 16 entry pulsed/steady table 404, which indicates, using one bit for each entry, whether the sequence should be repeated for the same display element on the subsequent cycle (steady, not pulsed) or whether it should be cleared (pulsed). Pulsed operation causes the corresponding entry in the pixel map to be cleared (zeroed) after display of the sequence.

In one embodiment, a timer in the microcontroller 310 is set to generate an interrupt at the expiration of each subinterval during the illumination of each row of display elements. At each interrupt, the microcontroller 310 looks up the corresponding entry in the pixel map for each display element in the row and then indexes the entry to the color palette table for the appropriate subinterval to determine whether to illuminate the corresponding red or green LED. The microcontroller 310 shifts the data for each LED to the shift registers 330 by pulsing the I/O bit connected to the clock input of the shift registers 330. Once the data is shifted into the registers, the microcontroller 310 latches the data through an I/O bit connected to the latch input of each of the shift registers. Once the data is latched, the microcontroller 310 illuminates the selected LEDs by raising the output enable of the shift registers 330 through another I/O bit.

In one embodiment, the microcontroller 310 receives data relating to disk operations and disk functions through a serial connection from the array controller 220 (FIG. 2). In the preferred embodiment, the array controller microprocessor 224 categorizes each disk operation into one of 64 activity bins. Each activity bin is an identifier (e.g. 0 to 63) that identifies a range of Logical Block Addresses (LBA) on a disk. In alternative embodiments, activity bins may correspond to physical addresses, for example, in Cylinder-Head-Sector (CHS) format. Each bin corresponds to one of the display elements 112 on the displays 110. The same mapping of LBAs to bins may be used for each of the drives in the disk array 200 (FIG. 2). For each disk operation, the array microprocessor 224 preferably sends to the microcontroller 310 an identification of the disk, the type of operation (read or write), and the associated activity bin. The microcontroller 310 takes the received information and updates the pixel map accordingly.

In another embodiment, for each disk operation, the array microprocessor 224 supplies the disk, the LBA, and the type of operation for each write operation performed to the microcontroller 310. The microcontroller 310 associates the received infornation with display elements and updates the pixel map accordingly.

D. Display Methods

Figure 5:
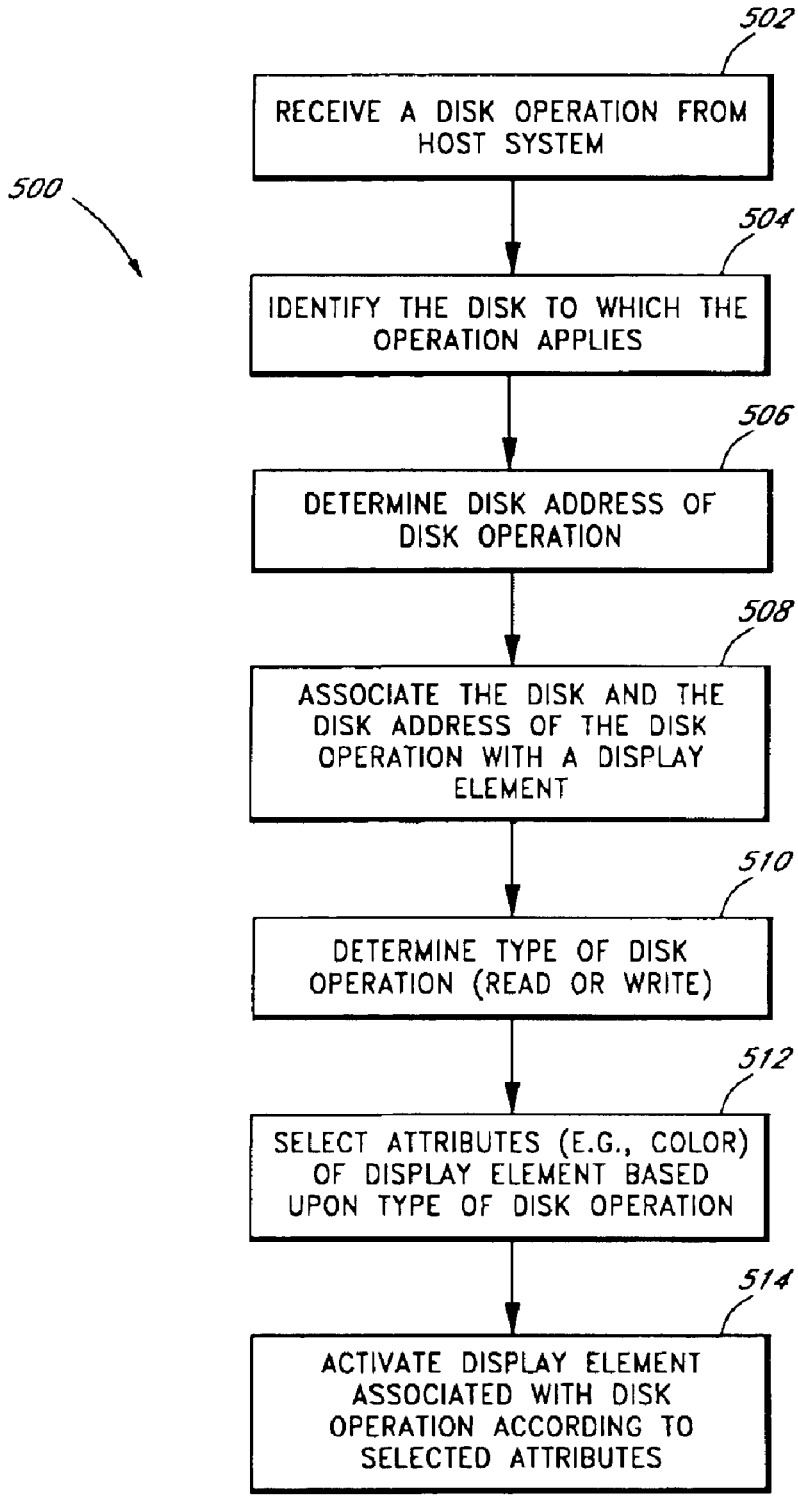
FIG. 5, illustrates a preferred method for displaying disk drive activity for one or more disk drives.

FIG. 5 illustrates a preferred method 500 for displaying disk drive activity for one or more disk drives. The array controller 220 and the disk array display card 250 are preferably configured to perform the method 500. The method 500 is preferably embodied within firmware, but may alternatively be embodied in hardware on the display card 250 and/or the array controller 220. In addition, as indicated above, the display method could be implemented within the drive electronics of a disk drive.

At a step 502, the array controller 220 receives a disk operation from a host system. The disk operation preferably identifies the desired action (e.g. read or write), the data (e.g. cylinder-head-sector or LBA) to be read or written, and the quantity of data, and possibly other data. The format of disk operation may vary depending upon the technology used, such as SCSI or ATA.

At a step 504, the array controller 220 identifies the disk or disks of the disk array 200 to which the disk operation applies. In some embodiments, a single operation may involve access to several disks, in which case the several disks are identified. In the preferred embodiment, the array controller 220 identifies the invoked disk(s) based in part upon the configuration (e.g. RAID 4, RAID 5) in which the disk array 200 is being operated. In some configurations the disk operation itself may specify the disk to which the operation applies.

At a step 506, the array controller 220 determines, for each invoked disk, the disk address of the disk operation. The disk address is preferably an LBA but may be a cylinder-head-sector (CHS) address. In some cases the address may be supplied in conjunction with the disk operation by the host system. In other cases, the array controller may determine the disk address of the disk operation in accordance with the configuration of the disk array (e.g. RAID).

At a step 508, the array controller 220 and/or the display microcontroller 310 associate the disk and the disk address with one or more display elements. The array controller 220 preferably maps the disk address to one or more activity bins using techniques described in Section II below. The display microcontroller 310, in turn, maps or indexes each activity bin/disk combination to one of the display elements 112 on one of the displays 110. The activity bins are preferably identified by the numbers 0 to 63 and the disks by the numbers 0 to 7. The display microcontroller preferably uses a simple algorithm to map the activity bin/disk combinations to the pixel map in which the display values are stored.

At a step 510, the array controller 220 and display microcontroller 310 determine the type of disk operation (e.g. read or write). The type of the operation is supplied to the array controller 220 by the host system as a part of the request for the operation. The array controller 220 preferably forwards the type of the disk operation to the display microcontroller 310 in conjunction with the activity bin/disk information for the operation.

At a step 512, the display microcontroller 310 selects the attributes of the display element(s) to be illuminated based upon the type of the disk operation. The attributes may include the color of the illumination and whether the illumination is to be pulsed or steady. The table 402 (FIG. 4) lists some of the attributes of the preferred embodiment.

At a step 514, the display microcontroller 310 activates the display element(s) associated with the disk operation according to the selected attributes. In the preferred embodiment, the display microcontroller updates the pixel map as its receives input from the array controller 220. The microcontroller may update one element of the pixel map while displaying elements of another row. After a row has been displayed, the microcontroller preferably clears the entry in the pixel map for the display elements based upon the entry in the pulsed steady table 404.

As will be understood by one skilled in the art, the method 500 is also applicable to displaying disk drive activity for a single drive as opposed to an array of drives. In this case, the step 504 and other aspects related to identifying the disk need not be performed. The method, in this case, may be performed by a disk drive controller through firmware and/or hardware. Such drives may be manufactured with output ports or connectors for connection to displays or display driver circuitry. In another embodiment, individual disk drives configured to perform the method 500 may also be incorporated in a disk array.

Mapping Disk Addresses to Display Elements

This section describes several techniques for mapping disk addresses to display elements. In general, the possible addresses of a disk drive are divided up into substantially equal sized activity bins. An activity bin is an identifier that is associated with a preferably contiguous range of addresses on a disk. The number of activity bins is preferably set equal to the number of display elements 112 used to represent disk activity for the disk. Alternatively, other mappings could be used, such as mapping each bin to two display elements. The following techniques are preferably performed by the array controller microprocessor 224 to associate disk address ranges with activity bins. The microprocessor 224 then passes an identification of the resulting bins to the display microcontroller 310 for activation of the associated display elements. As will be understood by one skilled in the art, these techniques may be used in the context of displaying disk activity for disk arrays as well as for single disks.

The following description assumes that 64 activity bins are used, numbered 0 to 63, to correspond to the 64 display elements for the display 110 for each drive. Other numbers of activity bins could alternatively be used. The following description also assumes that disk addresses are specified using LBA format, although other formats such as CHS could be used. An LBA is a 4 byte value that identifies a sector on a disk. The sectors of a disk are mapped to LBA values in sequence from 0 to the highest LBA on the disk.

A. Bit Masking Method

Figure 6A:
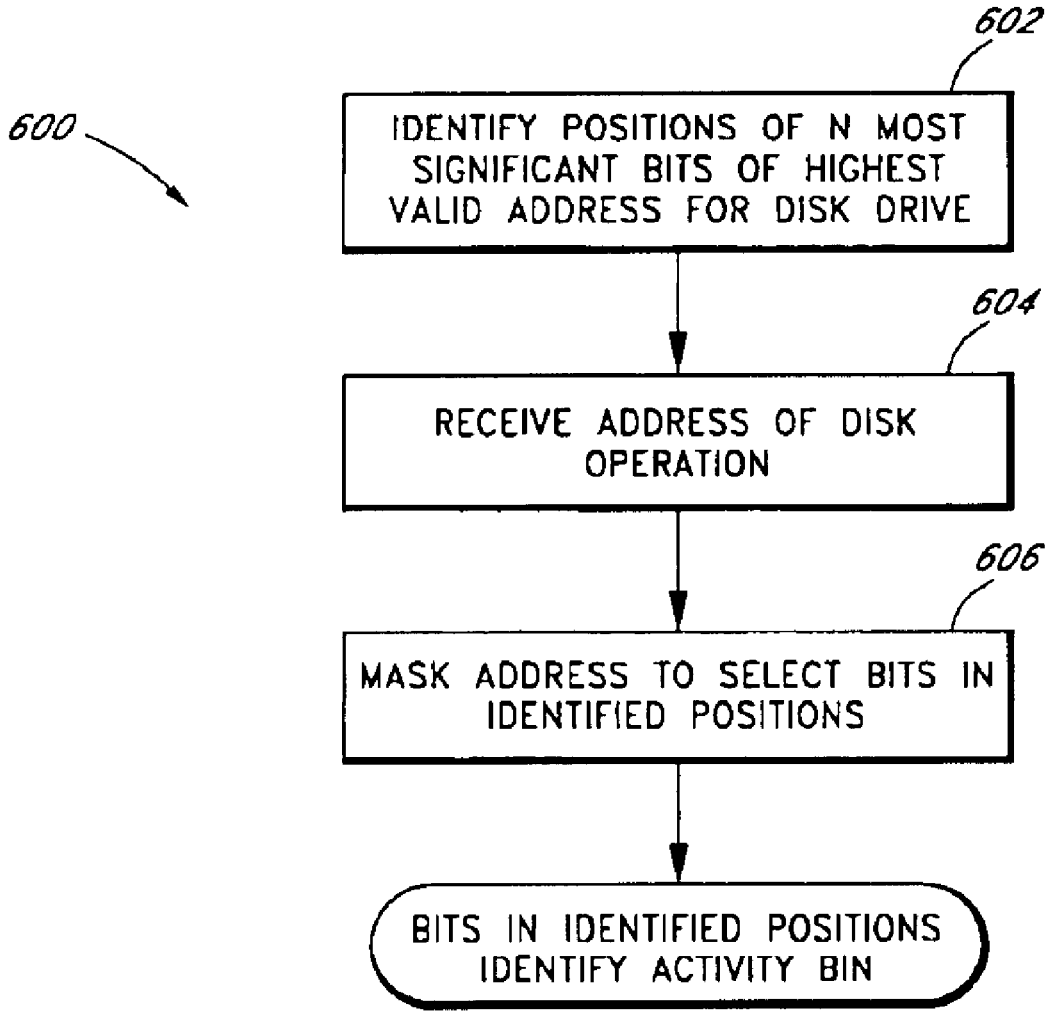
FIG. 6A illustrates one method for mapping disk addresses to activity bins.

FIG. 6A illustrates one method 600 for mapping disk addresses to activity bins. At a step 602, the positions of the N most significant bits are identified for the highest valid address for the disk drive. N is equal to the number of bits necessary to uniquely identify each of the activity bins. For example, it takes 6 bits to identify 64 activity bins, so N equals 6 in this case. The step 602 need only be performed once, during the initialization or setup of a system.

At a step 604, the address of a disk operation is received. At a step 606, the address of the disk operation is masked to select the bits in the identified bit positions. The bits in the identified bit positions of each disk address identify, in binary form, the bin associated with the address. The masking operation is preferably performed by shifting the address to the left and then to the right an appropriate number of bits.

FIG. 6B illustrates example pseudocode through which the method 600 may be implemented. The pseudocode is commented and will be understood by one skilled in the art.

The method 600 is simple and fast. The number of bins, however, is determined by the value of most significant bits in the highest valid address of the disk drive. As a result, this method does not function as well in situations where the number of display elements is fixed, but the size of the disk drives vary. For example, if the 6 most significant bits in the highest valid address are 100001, which represents 33 in decimal, then the method 600 will only map to 34 bins (bins 0 to 33). In this case, if there are 64 display elements, only 34 will be used.

B. Division Method

Figure 7A:
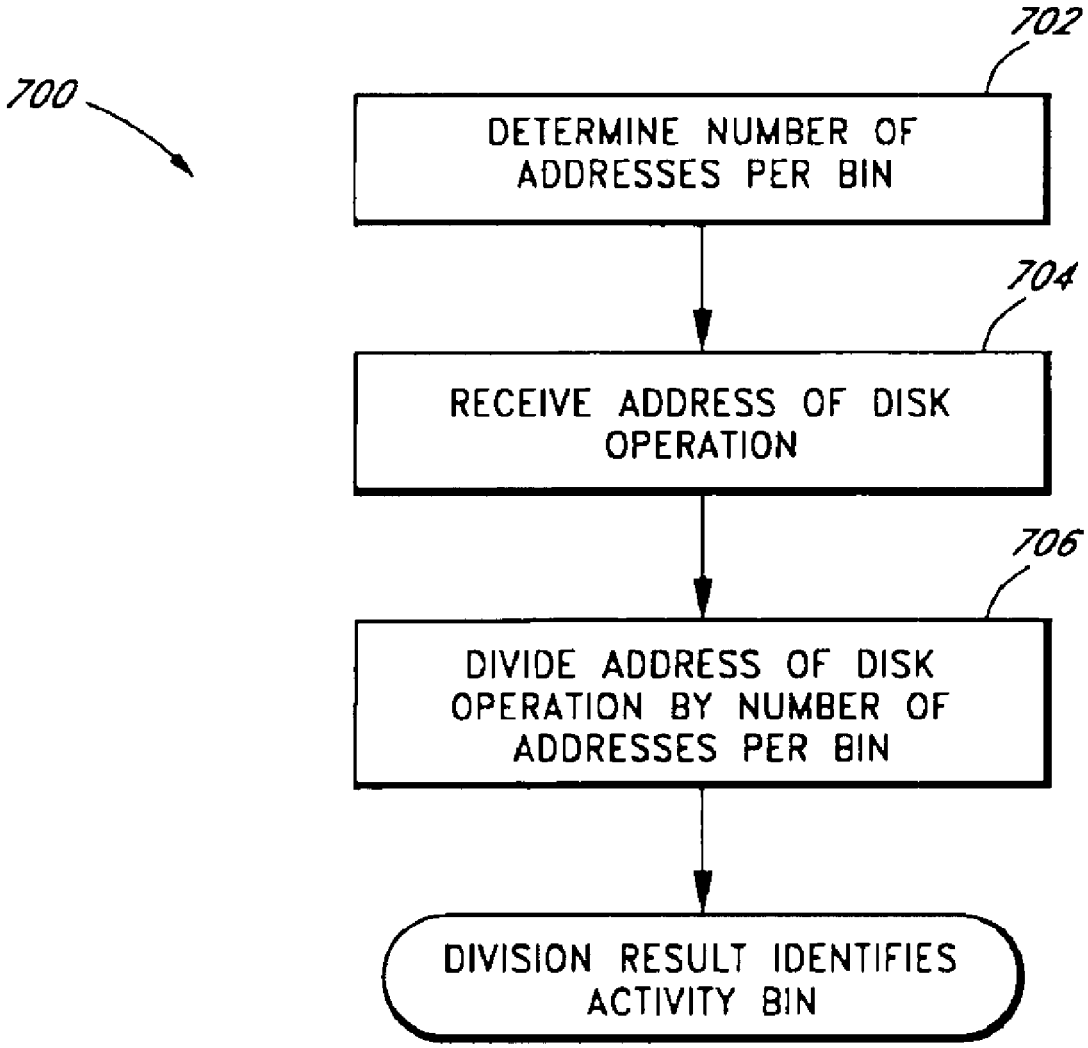
FIG. 7A illustrates another method method for mapping disk addresses to activity bins.

FIG. 7A illustrates another method 700 for mapping disk addresses to activity bins. At a step 702, the number of valid disk addresses per bin is determined preferably by dividing the number of valid disk addresses by the number of activity bins. The division is preferably performed with sufficient precision to produce an even distribution of addresses among activity bins. Increased precision will generally result in a more even distribution. The step 702 need only be performed once, during the initialization or setup of a system.

At a step 704, the address of a disk operation is received. At a step 706, the address of the disk operation is divided by the number of disk addresses per bin. The division is preferably again performed using real arithmetic, but the result is preferably rounded down to the nearest whole number. The result of the division is the activity bin associated with the disk address.

FIG. 7B illustrates example pseudocode through which the method 700 may be implemented. The pseudocode is commented and will be understood by one skilled in the art.

The method 700 is substantially slower than the method 600 since it involves two divisions. Divisions are fairly costly operations relative to masking and shifting operations. The method 700, however, allows any number of bins to be used. The valid disk addresses are associated evenly, to the extent possible, across the bins.

C. Lookup Table Method

Figure 8:
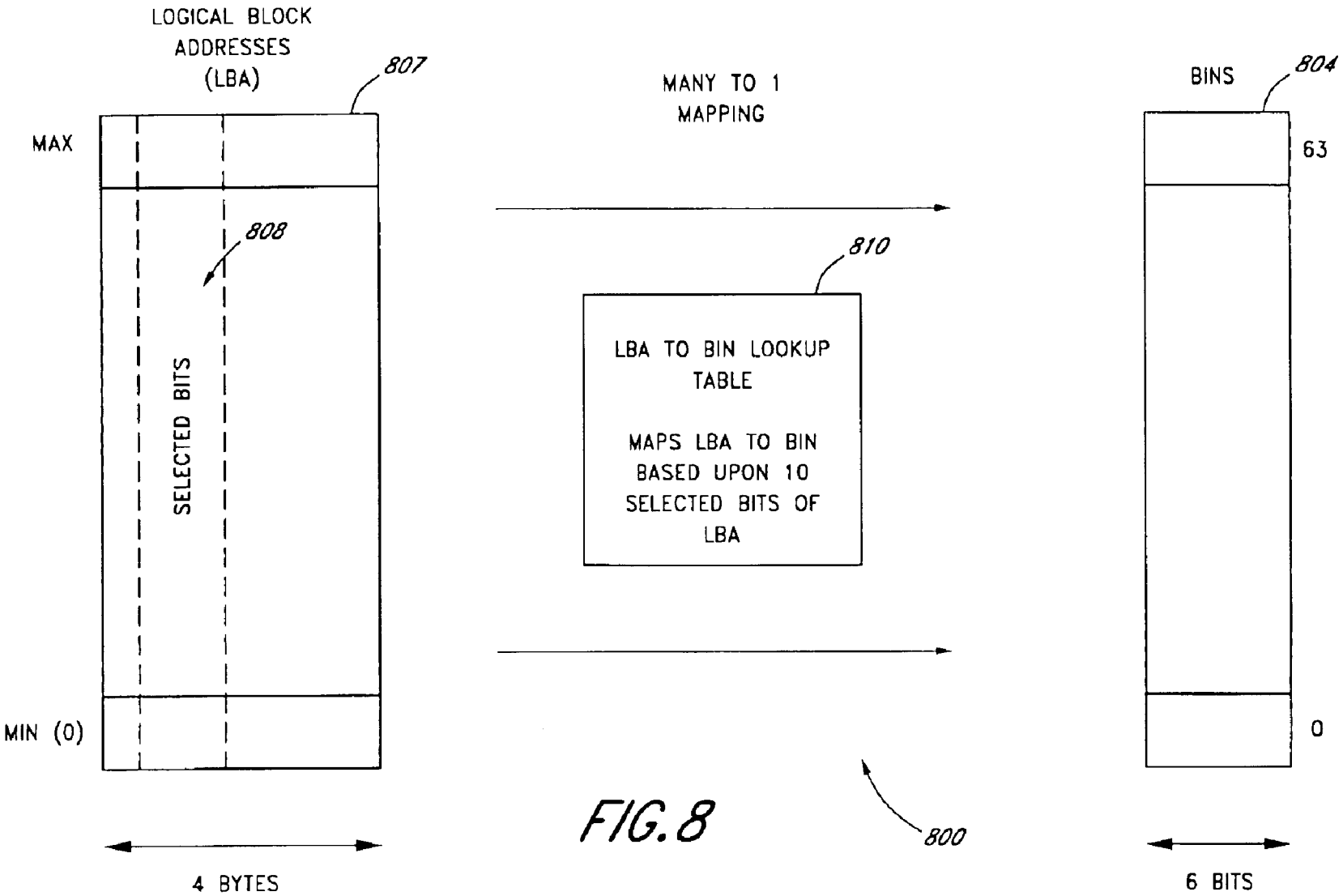
FIG. 8 illustrates a mapping of disk addresses to activity bins through a lookup table that can be used to achieve the benefits of the division method with the speed of the bit masking method.

FIG. 8 illustrates a mapping 800 of disk addresses 802 to activity bins 804 that can be used to achieve the benefits of the division method 700 with the speed of the bit masking method 600. The mapping 800 is defined by an LBA to bin lookup table 810 that maps selected bits 808 of LBAs to bins.

The selected bits 808 are preferably the bits in the bit positions of the N most significant bits of the highest valid LBA. In the preferred embodiment, N is 10, which allows up to 1024 different combinations of selected bits. The actual number of valid combinations of the selected bits will depend upon the value of the highest LBA of the disk drive. As will be understood by one skilled in the art, the 10 most significant bits of the highest LBA will always yield a value between 512 and 1023. In the preferred embodiment, there are 64 bins. Accordingly, the mapping 800 in the preferred embodiment is a many to one mapping in that at least 8 and at most 16 combinations of selected bits are mapped to each bin.

The selected bits are preferably mapped to bins evenly, such that each bin has at most one more combination of bits mapped to it than any other. As opposed to the bit masking method 600, the mapping 800 allows all of the bins to be used in addition to evenly mapping the addresses to bins.

Figure 9A:
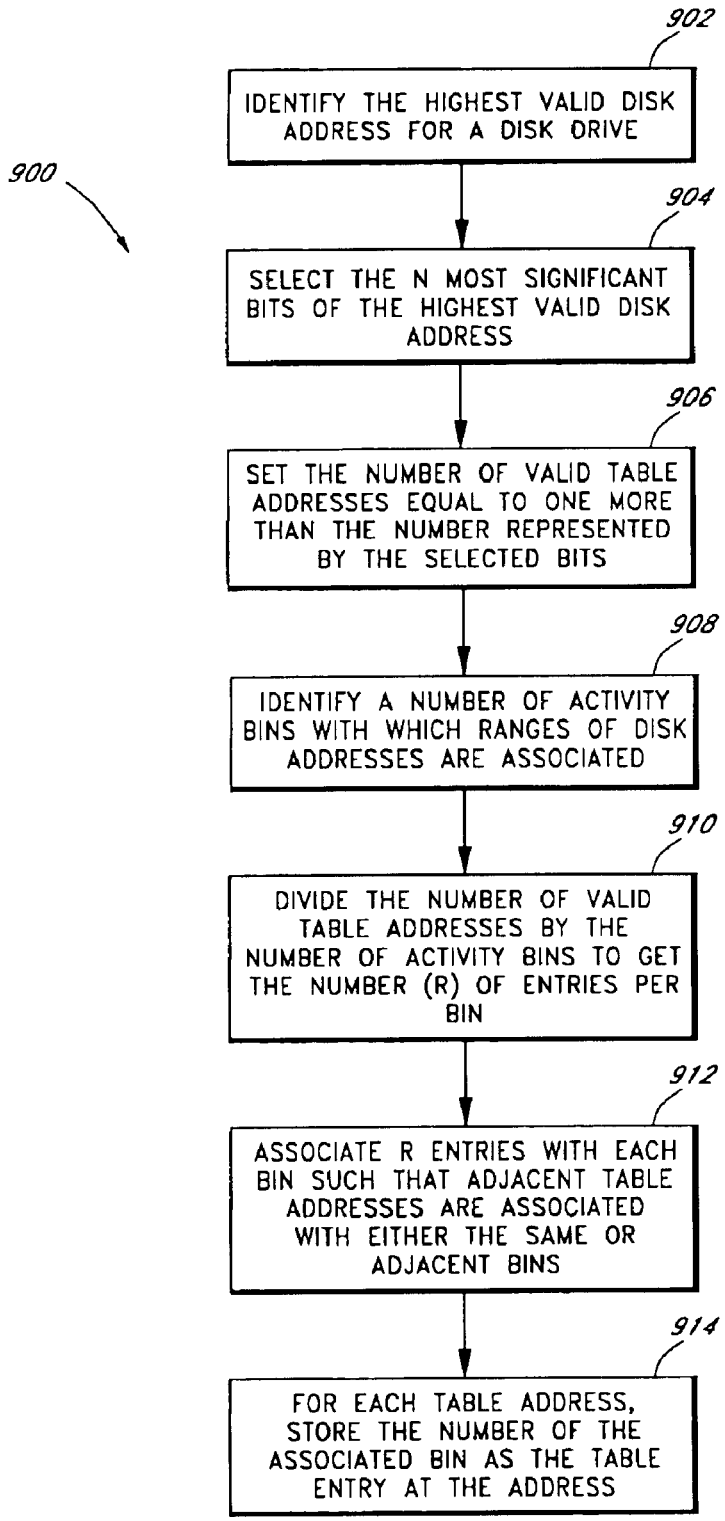
FIG. 9A illustrates a preferred method for creating the lookup table.

FIG. 9A illustrates a preferred method 900 for creating the lookup table 810. The method assumes that an empty table 810 is available having $2^{10}$ locations or 1023 locations in the preferred embodiment. Each location is capable of identifying a bin, which, in the preferred embodiment requires 6 bits for 64 bins.

The method 900 may be performed in any of several situations. If an array controller 220 is manufactured to function in conjunction with a particular model or size of disk drive, the method may be performed by the manufacturer of the disk array to create the table once for use in any number of products. In this case the table is preferably created in advance and loaded into the ROM 226 (FIG. 2) of the array controller 220. Alternatively, the array controller 220 may be configured to accept various sizes or models of disk drives in which case it may be desirable to configure the array controller 220 to perform the method 900 upon startup, initialization, or during a setup procedure. During system operation, the lookup table is preferably stored or cached in the RAM 228 to allow quick access.

At a step 902 of the method 900, the highest valid disk address of the disk or disks is identified. At a step 904, the N most significant bits of the highest valid disk address are selected. To select these bits, a shifting or masking technique can be used such as is described in the step 606 of the method 600.

At a step 906, the number of valid table addresses is set equal to one more than the number represented by the selected bits. In the preferred embodiment, the number of valid table addresses will be between 513 and 1024, depending upon the address of the highest valid address of the disk. Accordingly, in most cases, not all of the addresses in the table 810 will be used.

At a step 908, a number of activity bins are identified. Each of the activity bins are to be associated with a range of disk addresses. The number of activity bins preferably corresponds to the number of display elements 112 (FIG. 1) in each display 110 (FIG. 1). In the preferred embodiment, there are 64 activity bins that correspond to the 64 display elements. The 64 activity bins are each identified by a binary number, e.g. 000000 to 111111.

At a step 910, the number of valid table addresses is divided by the number of activity bins to get the number of addresses or table entries, (hereinafter R, for ratio) that are mapped to each bin. The division is preferably performed with sufficient precision to produce an even distribution of table addresses among activity bins. Increased precision will generally result in a more even distribution. At a step 912, R table addresses are mapped to each bin such that adjacently ordered table addresses are associated with either the same or adjacently ordered bins. The table addresses are mapped by entering the number of the associated bin in the table entry at the respective table address. The mapping maintains the relative order of entries in the bins to which the entries are mapped.

In the preferred embodiment, the division of the step 910 may yield a noninteger number for the ratio R. An integer number of entries, however, must be mapped to each bin. Accordingly, in the case that R is not an integer, some bins may have R rounded up the next whole number entries associated with them and some bins may have R rounded down to the previous whole number entries associated with them. For example, if there are 513 table entries and 64 activity bins, there will be 8.015625 entries per bin. Accordingly, one of the activity bins will have 9 entries mapped to it and the remaining 63 activity bins will have 8 entries mapped to each of them. If there are 1024 table entries, each of 64 activity bins will have exactly 16 entries mapped to it.

At a step 914, for each table address, the number of the associated bin is stored in the table 810 at the respective table address. The resulting table 810 provides a many to one mapping of the selected bits of each LBA to bins. The mapping allows all of the bins to be used and is a substantially even mapping. Any bin will have at most one more table entry mapped to it than any other bin. In the preferred embodiment, since each bin will have at least 8 entries mapped to it, the worst case ratio of numbers of entries per bin is 8 entries for some bins to 9 entries for other bins.

FIGS. 9B and 9C illustrate two different example pseudocode implementations of the method 900. The pseudocode is commented and will be understood by one skilled in the art.

Figure 10A:
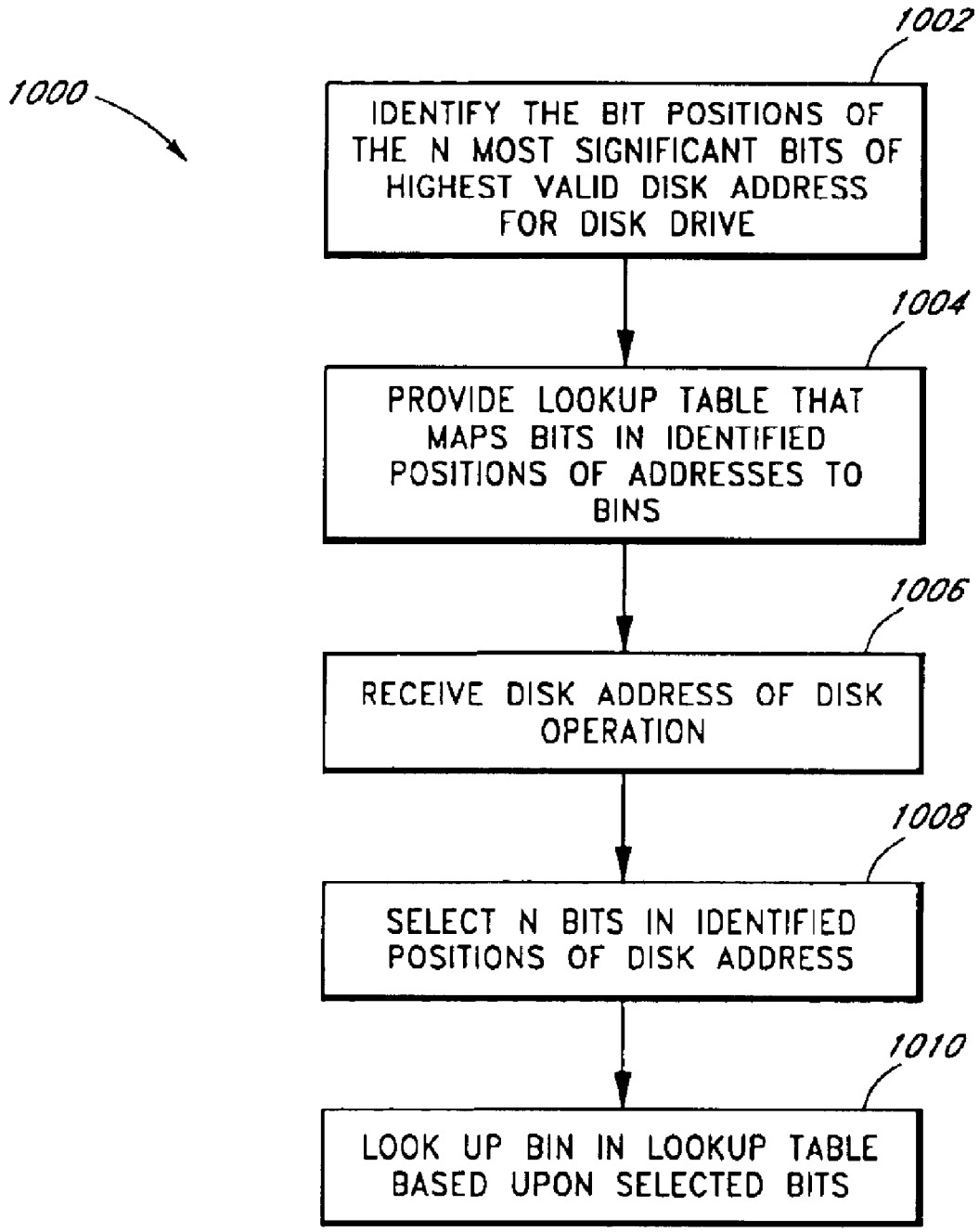
FIG. 10A illustrates a preferred method for associating disk addresses with activity bins using a lookup table.

FIG. 10A illustrates a preferred method 1000 for associating disk addresses with activity bins using a lookup table. The method 1000 is preferably performed by the array controller microprocessor 224 (FIG. 2). For each disk operation, the microprocessor 224, in turn, forwards the identified bin, the disk, and the type of operation to the disk array display card 250.

At a step 1002, the bit positions of the most significant N bits of the highest valid disk address for the disk drive are identified. These bit positions are the same bit positions selected in the step 904 of the method 900 and serve as an index to the table created in the method 900. At a step 1004, the bin lookup table 810 is provided, preferably in accordance with the method 900.

At a step 1006, the disk address of a disk operation is received. At a step 1008, the N bits in the identified positions are selected from the disk address. To select these bits, a shifting or masking technique can be used such as is described in the step 606 of the method 600. At a step 1010, the bin is looked up in the table 810 using the N selected bits of the disk address as an index into the table.

FIG. 10B illustrates example pseudocode through which the method 1000 may be implemented. The pseudocode is commented and will be understood by one skilled in the art.

D. Updating The Pixel Map

Figure 11:
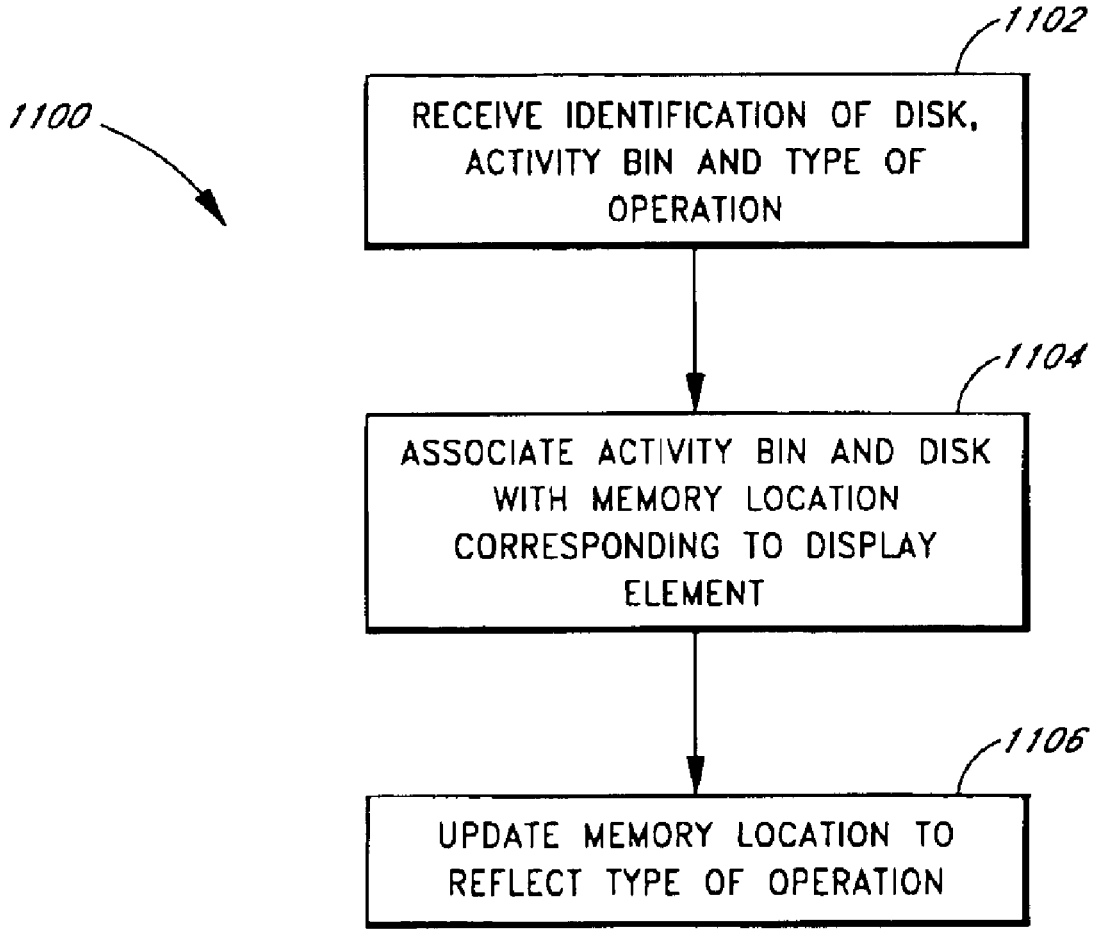
FIG. 11 illustrates a preferred method of using the activity bin information and other information supplied by the array microprocessor to update the displays.

FIG. 11 illustrates a preferred method 1100 of using the activity bin information and other information supplied by the array microprocessor 224 to update the displays 110. The method 1100 is preferably performed by the display microcontroller 310.

At a step 1102, the microcontroller 310receives an identification of the disk, the type of disk operation, and the activity bin associated with the disk address for a disk operation being executed by the disk array 200. At a step 1104, the microcontroller associates the activity bin and the disk with a location in its memory corresponding to a display element. The location in memory is preferably a 4 bit location within the pixel map discussion in Subsection I-C above. At a step 1106, the microcontroller updates the memory location to reflect the type of operation, such as a read or a write.

The array microprocessor 224 may also send to the display microcontroller 310 other signals or codes that signal the microcontroller to display information or data other than the location of reads or writes to disks. Codes can be supported that allow the implementation of any of the disk usages identified in FIG. 4. Other codes or conditions may also be supported as necessary.

III. Conclusion

Although the invention is implemented substantially in hardware in the illustrated embodiment, it will be recognized by one skilled in the art that the invention may be embodied completely or substantially completely within a software-implemented RAID system. It will be further recognized that the functionality for driving the displays and for identifying activity bins could also be incorporated into the disk drives themselves.

In one alternative embodiment, the display elements are arranged in a line and the indication of disk activity within a particular bin is indicated through the activation/illumination of all of the display elements before (or after) and possibly including the element corresponding to the bin. The effect in this case is similar to the effect displayed by graphic equalizers used in the audio field for displaying frequency spectra.

Although the invention has been described in terms of certain preferred embodiments, other embodiments that will be apparent to those of ordinary skill in the art, including embodiments which do not provide all of the features and advantages set forth herein, are also within the scope of this invention. Accordingly, the scope of the invention is defined by the claims that follow. In method claims, reference characters are used for convenience of description only, and do not indicate a particular order for performing a method.

What is claimed is:

1. A system for displaying activity data for a disk drive, the system comprising:

a display having multiple display elements, each display element occupying a different viewable region of the display; and a control circuit that displays real time disk drive activity data on the display in response to disk drive access operations such that each display element corresponds to a different address range of a plurality of address ranges of the disk drive;

whereby the display spatially indicates the address ranges accessed during the disk drive access operations, such that a user can evaluate whether the disk drive is being accessed randomly versus sequentially by visually monitoring a pattern with which the display elements are activated over time.

2. The system as in claim 1, wherein the plurality of address ranges are mutually exclusive address ranges of substantially equal size that collectively span an entire address space of the disk drive.

3. The system as in claim 2, wherein the control circuit comprises a processor programmed to subdivide the entire address space into the mutually exclusive address ranges of substantially equal size.

4. The system as in claim 1, wherein the control circuit generates a lookup table that maps disk drive addresses to the display elements, and uses the lookup table to identify display elements associated with the disk access operations.

5. The system as in claim 4, wherein each entry of the lookup table maps fewer than all of the bits of a disk drive address to a corresponding identifier.

6. The system as in claim 1, wherein each display element supports multiple display colors, and wherein the control circuit selects the display colors according to a type of the disk activity.

7. The system as in claim 6, wherein each display element comprises multiple LEDs.

8. The system as in claim 1, wherein the display comprises an N×M matrix of display elements wherein at least one of N and M is greater than two.

9. The system as in claim 8, wherein N=8 and M=8.

10. The system as in claim 8, wherein the control circuit further displays character-based disk status information on the N×M matrix.

11. The system as in claim 1, wherein the control circuit illuminates the display elements to which the disk access operations correspond.

12. The system as in claim 1, wherein the control circuit turns off the display elements to which the disk access operations correspond.

13. The system as in claim 1, wherein the display is positioned proximate the disk drive.

14. The system as in claim 1, wherein the control circuit controls the display based on logical block addresses of the disk access operations.

15. The system as in claim 1, further comprising a second display having multiple display elements in which each display element is assigned to a different address range of a second disk drive, wherein the first and second displays are controlled by the control circuit.

16. The system as in claim 15, wherein the control circuit comprises a first processor programmed to monitor disk accesses to at least the first and second disk drives, and a second processor programmed to update at least the first and second displays based on access information received from the first processor.

17. The system as in claim 16, wherein the first processor is programmed to control accesses to at least the first and second disk drives according to a RAID mode.

18. The system as in claim 1, wherein the display is generated on a computer screen by a computer program running on a general-purpose computer.

19. The system as in claim 1, wherein the control circuit is embodied within the disk drive.

20. A disk array system, comprising:

a plurality of disk drives housed within a cabinet;

a disk array controller housed within the cabinet, the disk array controller coupled to and configured to control the plurality of disk drives;

a plurality of displays, each display having multiple display elements and corresponding to a respective disk drive of the plurality of disk drives; and a control circuit that controls the plurality of displays in response to disk access operations performed by the disk array controller such that each display element of each display corresponds to a different address range of the corresponding disk drive;

whereby each display spatially represents address ranges of accesses to the corresponding disk drive, such that a user can evaluate whether a first disk drive is being operated as a mirror of a second disk drive by comparing patterns with which display elements are activated on the displays corresponding to the first and second disk drives.

21. The disk array system as in claim 20, wherein the displays are positioned in alignment with each other to facilitate comparisons of disk drive activity.

22. The disk array system as in claim 21, wherein the displays are positioned behind a transparent or translucent window of the cabinet.

23. The disk array system as in claim 20, wherein the address ranges associated with each display are mutually exclusive address ranges of substantially equal size that collectively span an entire address space of the corresponding disk drive.

24. The disk array system as in claim 20, wherein the control circuit comprises a processor of the disk array controller.

25. The disk array system as in claim 24, wherein the control circuit further comprises a second processor which refreshes the plurality of displays based on information received from the first processor.

26. The system as in claim 20, wherein each display element supports multiple display colors, and the control circuit selects the display colors according to a type of the disk activity.

27. The system as in claim 20, wherein each display comprises an N×M matrix of display elements wherein at least one of N and M is greater than two.

28. The system as in claim 27, wherein N=8 and M=8.

29. The system as in claim 27, wherein the control circuit further displays character-based disk status information on each N×M matrix.

30. A method of displaying disk drive activity data, the method comprising:

providing a plurality of display elements in which each display element is assigned to a different address range of a plurality of address ranges of a disk drive;

monitoring an access to the disk drive to identify an address range to which the access corresponds; and controlling the display according to said assignments of display elements to address ranges to spatially indicate represent the address range to which the access corresponds;

wherein the display elements are assigned to the address ranges such that sequential accesses to the disk drive cause the display elements to be activated sequentially.

31. The method as in claim 30, wherein providing a plurality of display elements comprises assigning the display elements to mutually exclusive address ranges of substantially equal size that collectively span an entire address space of the disk drive.

32. The method as in claim 31, further comprising determining the address ranges of substantially equal size by numerical division.

33. The method as in claim 30, further comprising storing the assignments of display elements to address ranges within a lookup table, and accessing the lookup table to identify a display element to which an access address corresponds.

34. The method as in claim 30, wherein each display element supports multiple display colors, and the method further comprises selecting the display colors according to a type of the disk access.

35. The method as in claim 30, wherein controlling the display comprises controlling an LED matrix positioned adjacent to the disk drive.

36. The method as in claim 30, wherein controlling the display comprises controlling an N×M matrix of display elements wherein at least one of N and M is greater than two.

37. The method as in claim 36, wherein N=8 and M=8.

38. The method as in claim 36, wherein controlling the display further comprises displaying character-based disk status information on the N×M matrix.

39. The method as in claim 30, wherein the address range assignments are based on logical block addresses, such that the display spatially indicates a logical block address range to which the access corresponds.

40. The method as in claim 30, wherein controlling the display comprises displaying the display elements on a computer screen.

41. The method as in claim 40, further comprising displaying, on said computer screen, a second plurality of display elements that correspond to, and depict disk drive activity of, a second disk drive, to enable a user to compare disk drive activity of two disk drives.

42. The method as in claim 40, wherein the method is performed under control of a computer program that provides functionality for monitoring storage resources over a computer network.

43. A computer-readable medium having stored thereon computer instructions that embody the method of claim 30.

44. The system as in claim 1, wherein each display element comprises a group of pixels on a display screen.

45. The system as in claim 1, wherein the display elements are provided on a computer display screen as a part of a graphical user interface of a system administration program.

46. The disk array system as in claim 20, wherein the plurality of displays are generated on a display screen as part of a graphical user interface.

47. The disk array system as in claim 46, wherein the graphical user interface embodies a drag-and-drop operation through which a user can drag and drop a display to a new screen location to perform a side-by-side comparison of two disk drives.

48. The disk array system as in claim 46, further comprising a computer program executed by a processor of said control circuit to generate said graphical user interface.

49. The disk array system as in claim 48, wherein the graphical user interface embodies a drag-and-drop operation through which a user of the computer program can drag and drop a display to a new screen location to perform a side-by-side comparison of two disk drives.

50. The disk array system as in claim 20, wherein each display element of the plurality of displays comprises a group of pixels on a display screen.

* * * * *

UNITED STATES PATENT AND TRADEMARK OFFICE

CERTIFICATE OF CORRECTION

PATENT NO. : 6,924,780 B1
DATED : August 2, 2005
INVENTOR(S) : Horst et al.

It is certified that error appears in the above-identified patent and that said Letters Patent is hereby corrected as shown below:

Column 15,
Line 41, after "spatially" delete "indicate".

Signed and Sealed this

Twenty-eighth Day of March, 2006

JON W. DUDAS
*Director of the United States Patent and Trademark Office*